US010174513B2

(12) United States Patent
Lo et al.

(10) Patent No.: US 10,174,513 B2
(45) Date of Patent: Jan. 8, 2019

(54) CONCRETE FORM SYSTEM WITH MOVABLY CONNECTED BRACES

(71) Applicant: Soteria Industries Inc., Calgary (CA)

(72) Inventors: Ian K. Y. Lo, Calgary (CA); Ken Muldrew, Calgary (CA); Paul Sciore, Calgary (CA)

(73) Assignee: SOTERIA INDUSTRIES, INC., Calgary, AL (CA)

( * ) Notice: Subject to any disclaimer, the term of this patent is extended or adjusted under 35 U.S.C. 154(b) by 0 days.

(21) Appl. No.: 15/233,654

(22) Filed: Aug. 10, 2016

(65) Prior Publication Data

US 2017/0044781 A1 Feb. 16, 2017

Related U.S. Application Data

(60) Provisional application No. 62/203,379, filed on Aug. 10, 2015.

(51) Int. Cl.

| | |
|---|---|
| ***E04G 17/14*** | (2006.01) |
| ***E04G 9/02*** | (2006.01) |
| ***E04G 9/08*** | (2006.01) |
| ***E04G 17/00*** | (2006.01) |
| ***E04G 9/04*** | (2006.01) |

(52) U.S. Cl.

CPC ..... *E04G 17/002* (2013.01); *E04G 9/04* (2013.01); *E04G 9/08* (2013.01); *E04G 17/14* (2013.01); *E04G 2009/028* (2013.01)

(58) Field of Classification Search

CPC ... E04G 9/08; E04G 2009/028; E04G 17/002; E04G 17/14

See application file for complete search history.

(56) References Cited

U.S. PATENT DOCUMENTS 2,244,107 A * 6/1941 Hayes ..... E04G 15/065 249/180
2,332,166 A * 10/1943 Reiner ..... E04G 11/12 249/34
2,741,821 A * 4/1956 Findley ..... E04G 17/14 248/354.3
2,882,101 A * 4/1959 Michalak ..... E04G 5/04 182/113
2,914,833 A 12/1959 Hart et al.

(Continued)

FOREIGN PATENT DOCUMENTS

CH 157279 A * 9/1932 ..... E04G 17/14
DE 2142150 A1 * 3/1972 ..... E04G 11/12

(Continued)

OTHER PUBLICATIONS

International Search Report and Written Opinion for PCT/IB2016/001219, dated Oct. 7, 2016.

(Continued)

*Primary Examiner* — Michael Safavi
(74) *Attorney, Agent, or Firm* — Bryan D. Zerhusen, Esq.; Cantor Colburn, LLP

(57) ABSTRACT

In accordance with at least one aspect of this disclosure, a concrete form can include a forming wall including a concrete contact side and a bracing side and a plurality of braces movably connected to the bracing side of the forming wall, wherein the plurality of braces move between a retracted position and a bracing position.

28 Claims, 10 Drawing Sheets

(56) References Cited

U.S. PATENT DOCUMENTS 3,559,944 A * 2/1971 Clough ..... E04G 11/18 249/152
4,673,060 A * 6/1987 Gregory ..... E04G 5/06 182/113
5,233,807 A * 8/1993 Spera ..... E04G 11/12 52/837
5,343,667 A * 9/1994 Peden ..... E04G 17/06 249/219.1
5,456,444 A * 10/1995 Wegman ..... E04G 11/10 249/191
6,539,677 B1 * 4/2003 Lanka ..... E04G 17/002 248/354.3
7,913,463 B2 3/2011 Russell et al.
2006/0201743 A1 * 9/2006 Dell'Erba ..... E04G 13/00 182/82
2007/0175174 A1 * 8/2007 Bruno ..... E04G 17/14 52/745.12
2008/0173788 A1 * 7/2008 Brewka ..... E04G 11/10 249/189
2009/0057518 A1 * 3/2009 Russell ..... E04G 17/002 248/354.1
2009/0101774 A1 * 4/2009 Shih ..... E04G 17/14 248/200.1
2011/0285044 A1 * 11/2011 Sollars ..... E04G 13/00 264/31
2014/0265027 A1 * 9/2014 Kreizinger ..... E04G 11/02 264/299

FOREIGN PATENT DOCUMENTS

FR 1484808 A * 6/1967 ..... E04G 17/14
GB 716061 A * 9/1954 ..... E04G 9/08

OTHER PUBLICATIONS

International Preliminary Report on Patentability for PCT/IB2016/001219, dated Feb. 13, 2018.

* cited by examiner

CONCRETE FORM SYSTEM WITH MOVABLY CONNECTED BRACES

CROSS-REFERENCE TO RELATED APPLICATIONS

The present application claims the benefit of U.S. Provisional Patent Application Ser. No. 62/203,379 filed on Aug. 10, 2015; titled: "Concrete Form System", which is incorporated herein by reference in its entirety.

TECHNICAL FIELD

The present disclosure relates to construction equipment, more specifically to concrete forming systems and assemblies comprising the same.

BACKGROUND

Modern concrete forming structures are typically erected using a plurality of prefabricated, interlocking form sections or panels which may be reused indefinitely to produce any number of concrete structures. The forms or panels are designed to be interconnected end-to-end as well as in opposed relationship, to present a wall form for example.

For purposes of end-to-end interconnection, the panels generally include vertically extending end walls having a series of spaced openings therethrough. When aligned in juxtaposition, the individual panels are typically interconnected, such as by means of slotted pin and wedge assemblies. When the form is disassembled, the wedges are loosened and removed, and the pins extracted from the form panel apertures.

These concrete form sections are necessarily of relatively high strength, yet preferably they are compact and lightweight to effect savings in handling, transportation, and storage. Hence, the sections are generally constructed from a panel of lightweight metal such as aluminum and have a reinforcing grid secured to the back side of the panel for providing the necessary strength to resist buckling under the weight of the poured concrete.

Significantly, the reinforcing grid assemblies can be bulky, which adds significant weight and/or size to the panels. Alternatively, concrete forms might require builders to manually assemble the reinforcing grid assembly for each concrete forming panel. This is a very time consuming process that requires the handling of multiple pieces of material to build and support a desired concrete form.

Despite the widespread use of such systems, there is still a need in the art for improved concrete forming systems.

SUMMARY

The present disclosure provides a concrete form or panel system, as well as assemblies comprising the same, which addresses one or more of the above shortcomings.

In accordance with at least one aspect of this disclosure, a concrete form can include a forming wall including a concrete contact side and a bracing side and a plurality of braces movably connected to the bracing side of the forming wall, wherein the plurality of braces have two positions, a retracted position and a bracing position. In certain embodiments, the braces are configured to be reversibly moved and/or secured between the retracted position and the bracing position.

In certain embodiments, the forming wall is formed of a lightweight, durable material, e.g., plywood, aluminum or other metal, and the like. In additional embodiments the forming wall can include a plurality of cross-brace apertures, each cross-brace aperture disposed between a pair of braces. Each of the cross-brace apertures can be accessible when the braces are in either of the retraced position and the bracing position. The plurality of cross-brace apertures can include different sizes to accommodate different portions of a tapered connection rod. In certain embodiments, the concrete contact side of the forming wall can include a coating for preventing concrete from adhering thereto.

In certain embodiments, the braces of the form can include at least one I-beam. In additional embodiments, at least one of the plurality of braces can be a scaffold member. In still additional embodiments, the scaffold member can include a plurality of holes defined therein to reduce weight of the scaffold member.

In certain embodiments, the concrete form can further include a control bar operatively connected to each brace to move the plurality of braces between the retracted position and the bracing position. In additional embodiments, the control bar can be hingedly connected to at least one of the braces. In certain embodiments, the control bar can extend through the scaffold member.

In certain embodiments, the concrete form can further include two angled bracket members attached to opposite edges of the forming wall and configured to receive a hinge pin therein. In additional embodiments, the hinge pin can be configured to hingedly mount each brace to the bracing side of the forming wall. In still additional embodiments, each angled bracket member can include a keyhole fastener slot for joining a plurality of concrete forms together.

In certain embodiment, the concrete form can include a plurality of brace stops operatively disposed on the bracing side of the forming wall and in communication with each brace such that each brace stop aligns each brace perpendicular to the forming wall. In certain additional embodiments, the brace stops can include angled bracket members disposed on the bracing side.

In additional embodiments, the scaffold member can include scaffold supports configured to support the scaffold member when the scaffold member is in the bracing position. In certain embodiments, the scaffold supports can be hingedly mounted to the scaffold member to move between a folded position such that each of the scaffold supports is folded against the scaffold member, and a support position such that the scaffold supports are perpendicular to the scaffold member. In other embodiments, the scaffold supports can be triangular shaped members or any other suitable shape.

In another aspect, the description provides an assembly of a plurality of forms or panels as described herein. In a preferred embodiment, the plurality of forms are juxtaposed or in apposition, and reversibly interconnected in at least one of vertically, horizontally or a combination thereof.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
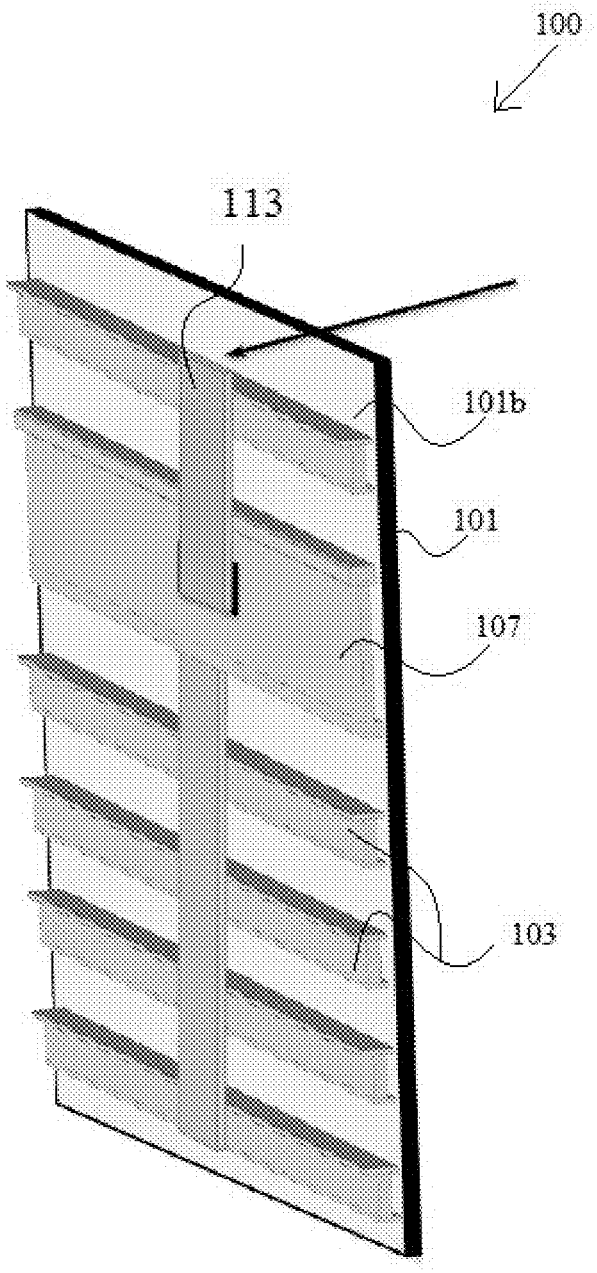
FIG. 1 is a perspective view of an embodiment of a concrete form in accordance with this disclosure, showing the braces in a retracted position.

Reference will now be made to the drawings wherein like reference numerals identify similar structural features or aspects of the subject disclosure. For purposes of explanation and illustration, and not limitation, an illustrative view of an embodiment of a concrete form in accordance with the disclosure is shown in FIG. 1 and is designated generally by reference character 100. Other embodiments and/or aspects of this disclosure are shown in FIGS. 2-13. The systems and methods described herein can be used to form concrete structures with easy assembly, storability, and modularity of the concrete forms.

Figure 2:
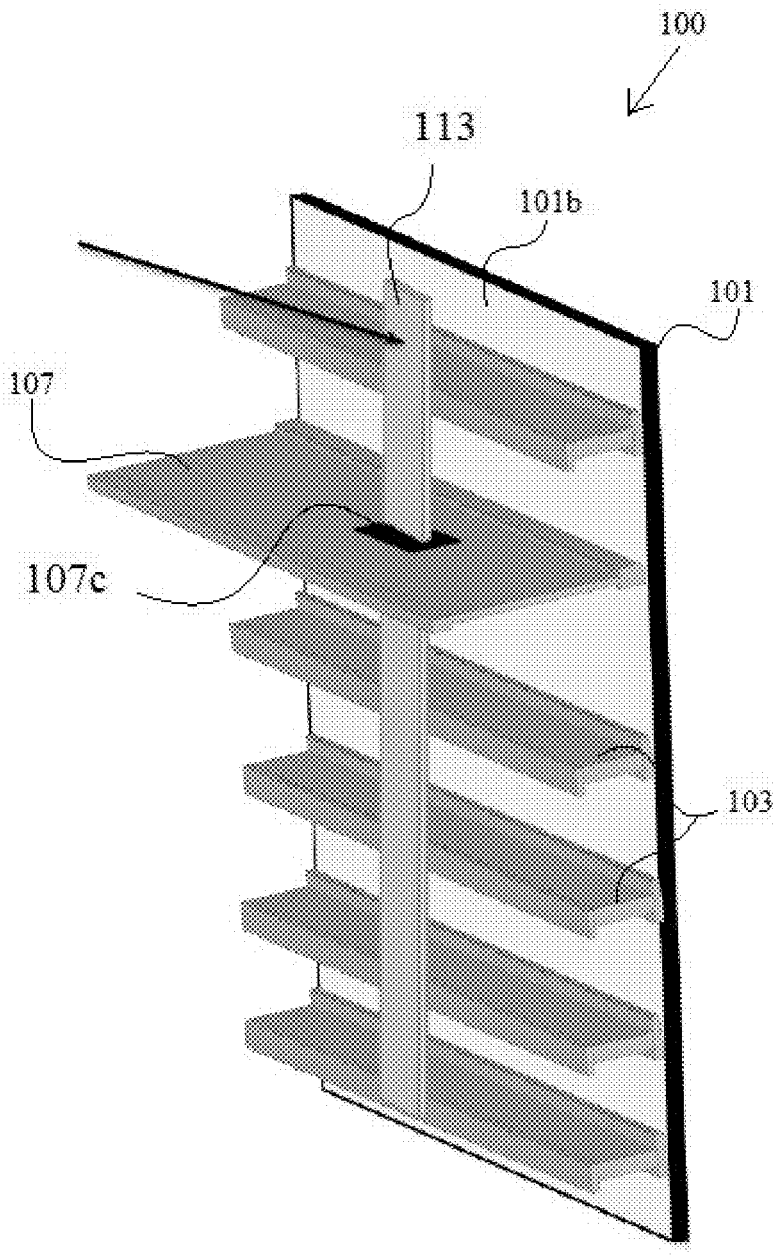
FIG. 2 is a perspective view of the concrete form of FIG. 1, showing the braces in a bracing position.
Figure 3:
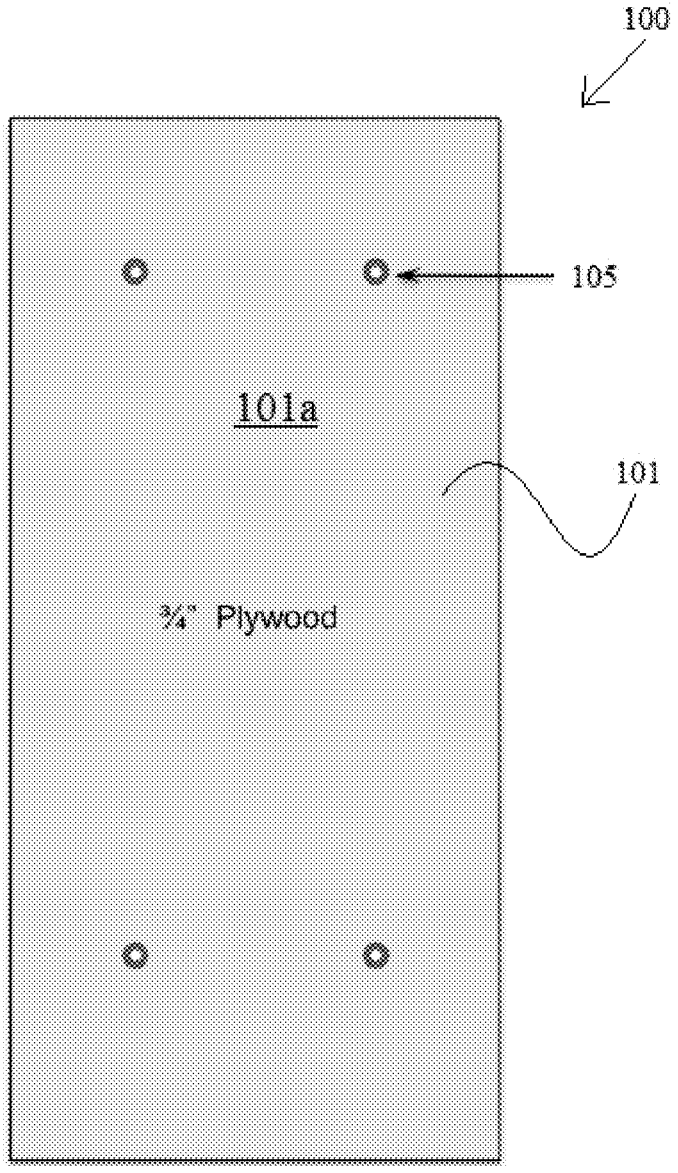
FIG. 3 is a front view of the concrete form of FIG. 1, showing cross-brace apertures defined therein.

In accordance with at least one aspect of this disclosure, referring to FIGS. 1-4, a concrete form 100 can include a forming wall 101 including a concrete contact side 101*a* (e.g., as shown in FIG. 3) and a bracing side 101*b*. One or more braces 103 can be movably connected to the bracing side 101*b* of the forming wall 101. The braces 103 can be moved between a retracted position (e.g., as shown in FIG. 1) and a bracing position (e.g., as shown in FIG. 2).

In certain embodiments, the forming wall 101 is a lightweight but durable material. For example, in certain embodiments, the forming wall is selected from the group consisting of plywood, metal, e.g., aluminum, alloy, carbon fiber, plastic, or any other suitable material and combinations thereof. The forming wall can have any suitable thickness, length, and/or width. It is contemplated that the concrete contact side of the forming wall 101 can include any suitable coating for preventing concrete from adhering thereto.

Figure 4:
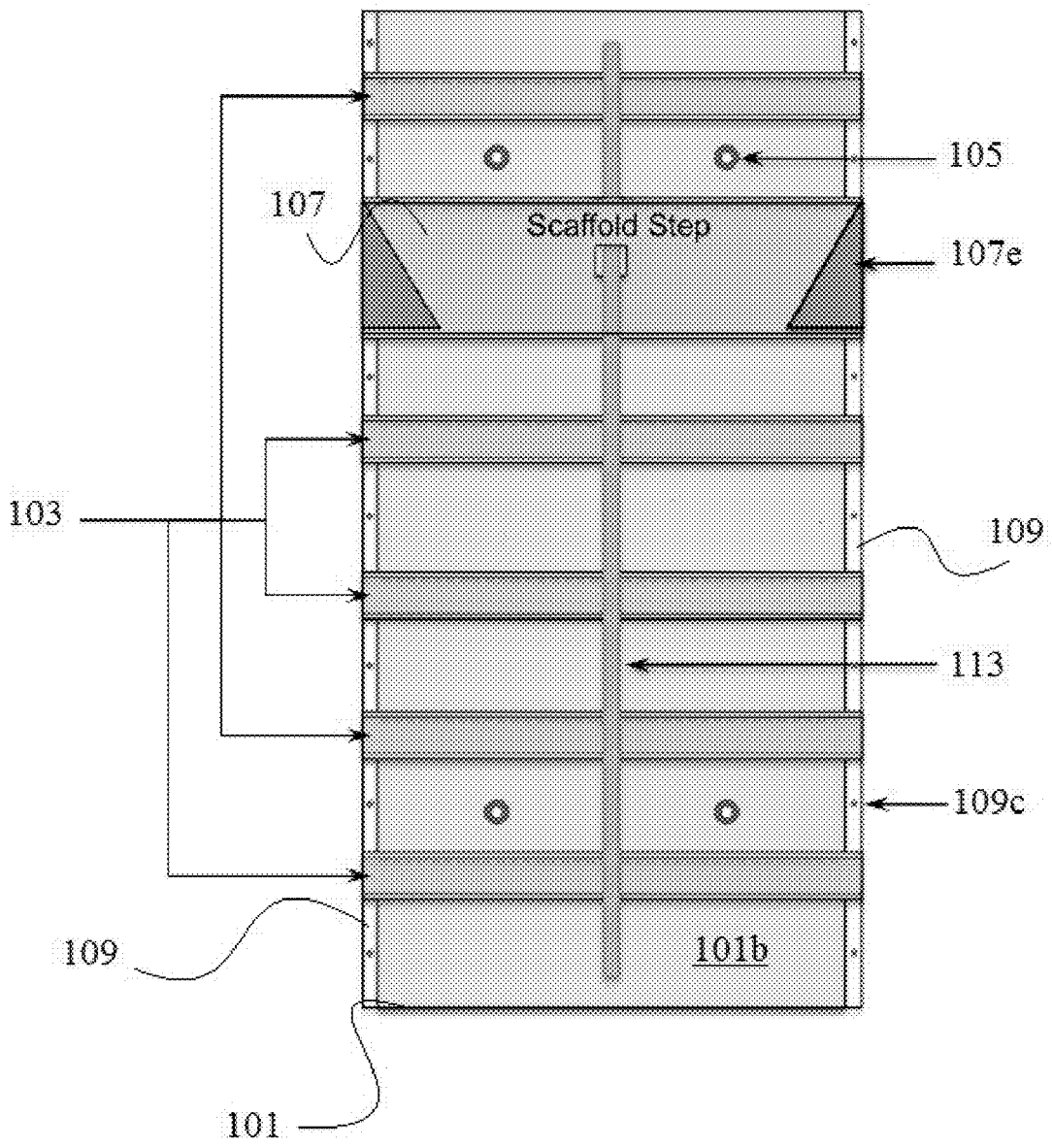
FIG. 4 is a rear view of the concrete form of FIG. 1, showing the bracing in the retracted position.
Figure 13:
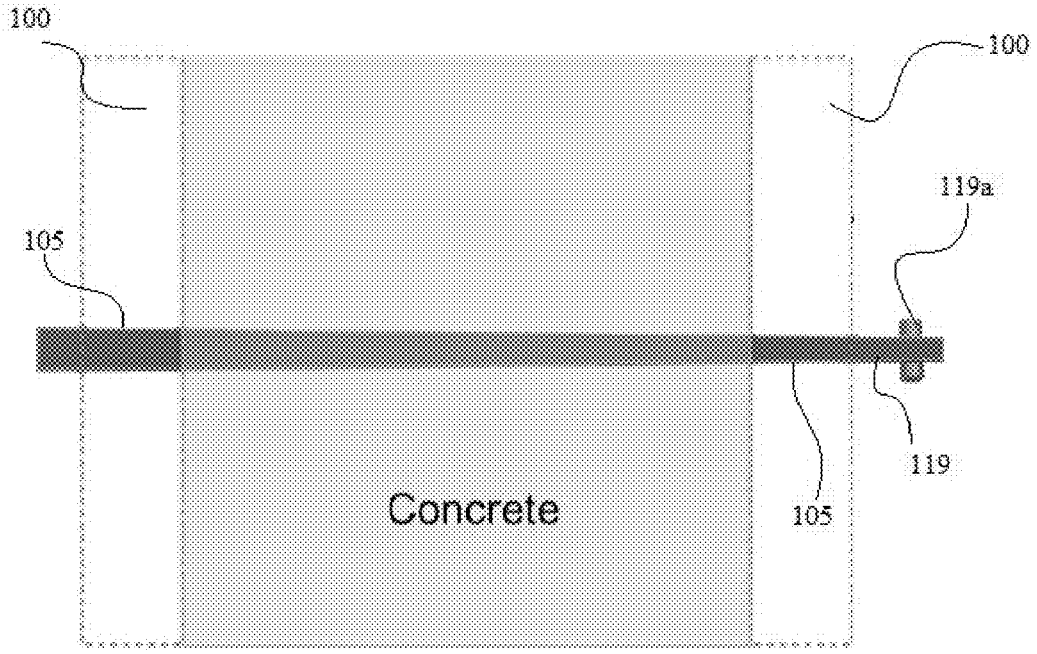
FIG. 13 is a cross-sectional view of a pair of concrete forms in accordance with this disclosure, shown attached together with a tapered connection rod while retaining a quantity of concrete therebetween.

Referring to FIG. 3, the forming wall 101 can include a plurality of cross-brace apertures 105. As shown in FIG. 4, each cross-brace aperture 105 can be disposed between a pair of braces 103. For example, each of the cross-brace apertures 105 can be accessible when the braces 103 are in either or both of the retraced position and/or the bracing position. Any other suitable location for the cross-brace apertures 105 is contemplated herein. The plurality of cross-brace apertures 105 can include different sizes (e.g., diameters) to accommodate different portions of a tapered connection rod (e.g., as shown in FIG. 13).

Referring to FIG. 2, the braces 103 can include at least one I-beam. It is contemplated that the braces 103 can include a modified I-beam shape, a T-beam shape, an H-beam shape, I-shape, or any other suitable shape. In certain embodiments, a portion of the braces 103 that contacts the forming wall 101 in the bracing position can include a greater surface area than an opposing side of the brace 103, which can reduce the weight of each brace 103. Also, portions of the upper surface of I-beam or similar braces 103 can be removed to allow for dirt removal.

Figure 5:
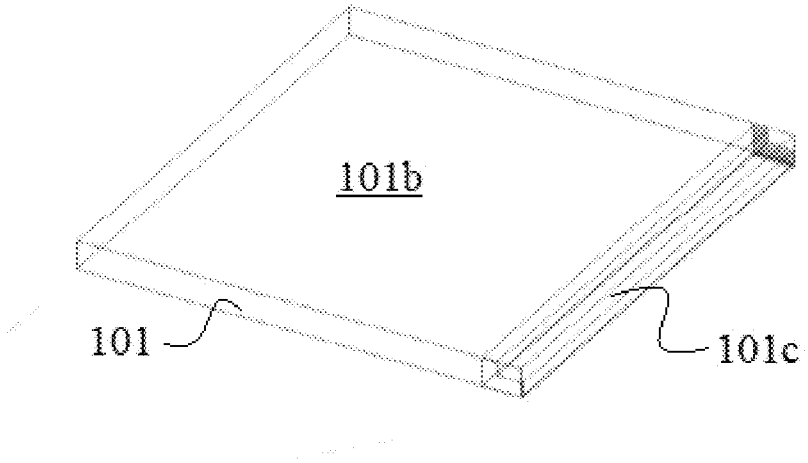
FIG. 5 is a partial perspective view of an edge portion of the forming wall of FIG. 1, showing a dado disposed and/or formed on the edge of the forming wall.
Figure 6:
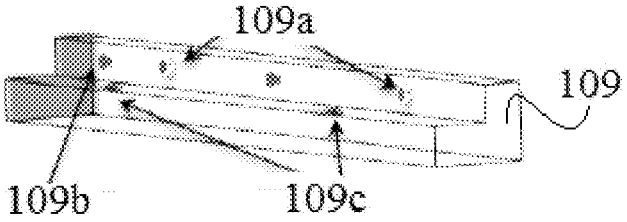
FIG. 6 is a partial perspective view of an embodiment of an angled bracket member, shown configured to be attached the dado as shown in FIG. 5.
Figure 7:
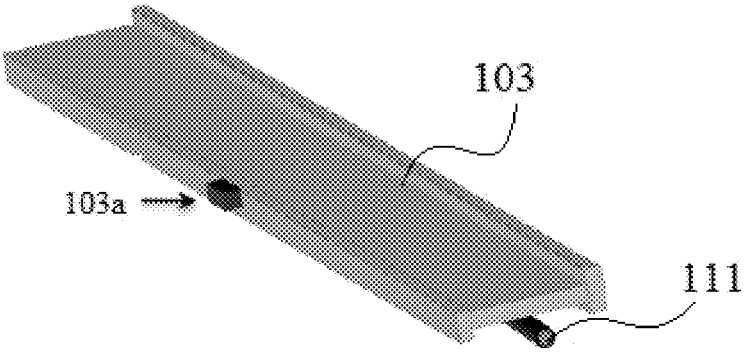
FIG. 7 is a perspective view of an embodiment of a brace in accordance with this disclosure, shown having a hinge pin disposed thereunder.

Referring to FIGS. 5-7, the concrete form 100 can further include two or more angled bracket members 109 attached to opposite edges of the forming wall 101 and configured to receive a hinge pin 111 therein (e.g., in pin holes 109*a* as shown in FIG. 6). The hinge pin 111 can be configured to hingedly mount each brace 103 to the bracing side 101*b* of the forming wall 101.

Each angled bracket member 109 can include one or more keyhole fastener slot 109 for joining a plurality of concrete forms 100 together using a suitable fastener. The angled bracket members 109 can be made from any suitable material (e.g., aluminum). Any other suitable modular locking and/or connection mechanism is contemplated herein.

As shown in FIG. 5, the edges of the forming wall 101 can include a dado 101*c* which forms a cut out in the forming wall 101 to accept the angled bracket member 109. In certain embodiments, the dado 101*c* and the angled bracket members 109 can be sized such that an attachment flange of the angled bracket member 109 sits flush relative to the bracing side 101*b* within the dado 101*c*. Referring to FIG. 6, the angled bracket members 109 can be mounted to the dado 101*c* or any other suitable portion of the forming wall 101 with any suitable fastener (e.g., nails, screws) through fastener holes 109*c* as shown.

Referring to FIGS. 1 and 2, at least one of the braces 103 can be a scaffold member 107. The scaffold member 107 can be configured to support the weight of a person walking thereon when in the bracing position (e.g., as shown in FIG. 2). As shown, the scaffold member 107 can be located near a top portion of the forming wall 101, however, any suitable vertical location for the scaffolding member 107 is contemplated herein.

Figure 8:
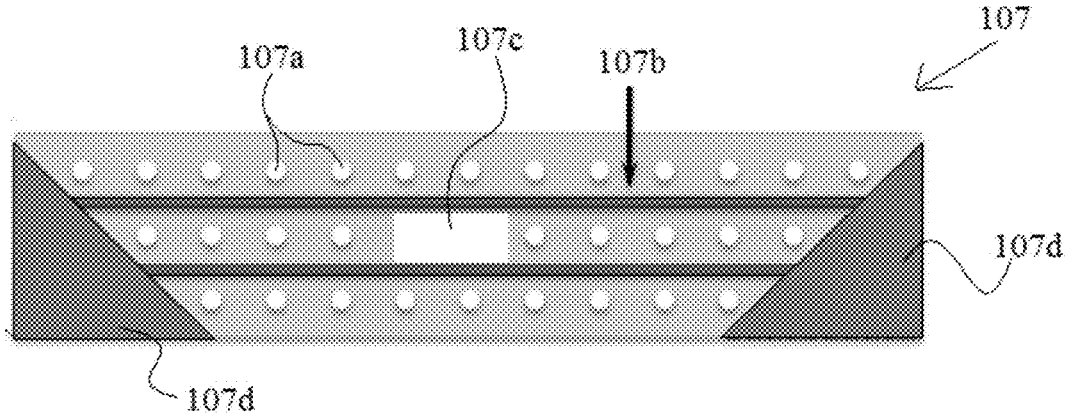
FIG. 8 is a bottom view of an embodiment of a scaffold in accordance with this disclosure, showing including added bracing and folding supports.

Referring additionally to FIG. 8, the scaffold member 107 can include a plurality of holes 107*a* defined therein to reduce weight of the scaffold member 107, for example. The holes 107*a* can be drilled or otherwise disposed in any suitable manner in the scaffold member 107. The scaffold member 107 can include scaffold bracing 107*b* (e.g., metal rods or the like) that run across the length of the scaffold member 107 to additionally support the scaffold member 107.

Figure 9:
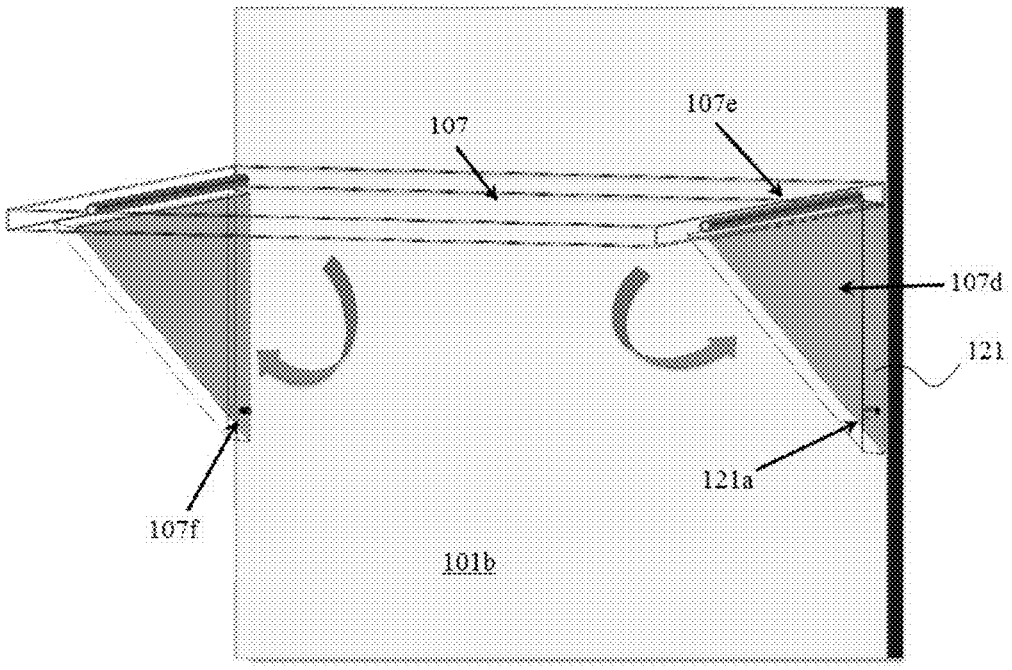
FIG. 9 is a perspective view of the scaffold of claim 11, shown in bracing position with the scaffold supports in a supporting position.

Referring additionally to FIG. 9, the scaffold member 107 can include scaffold supports 107*d* configured to support the scaffold member 107 when the scaffold member 107 is in the bracing position (e.g., as shown in FIGS. 2 and 9). In certain embodiments, the scaffold supports 107*d* can be hingedly mounted to the scaffold member 107 (e.g., via hinge pins 107*e*) to move between a folded position (e.g., as shown in FIG. 8) such that each of the scaffold supports 107*e* is folded against the scaffold member 107, and a support position such that the scaffold supports 107*e* are perpendicular to the scaffold member 107 (e.g., as shown in FIG. 9). As shown, the scaffold supports 107*e* can be triangular shaped members. Any other suitable shape for the scaffold supports 107*e* is contemplated.

The scaffold supports 107*d* can include a suitable locking system associated therewith to removably lock the scaffold supports 107*d* in the support position. For example, a flange 121 can me mounted on the bracing side 101*b* of the forming wall 10 land can be configured to receive a locking pin 107*f* that attached to the scaffold supports 107*d* within a lock hole 121*a*. Any other suitable system to lock the scaffold supports 107*d* in the support position is contemplated herein.

Figure 10:
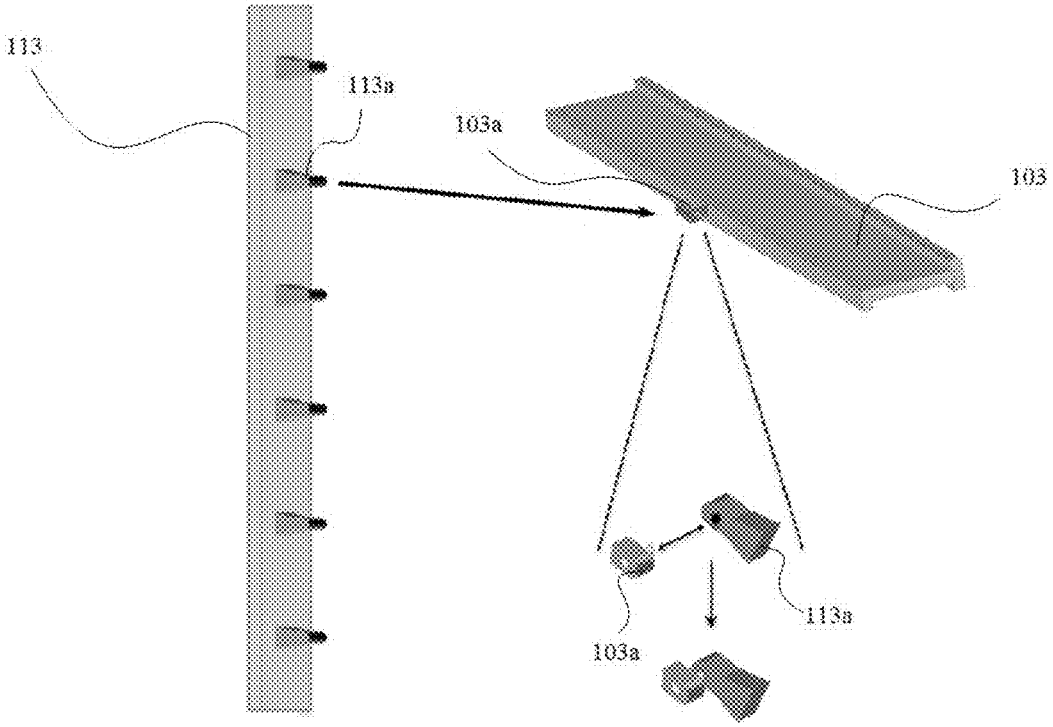
FIG. 10 is a partial perspective exploded view of an embodiment of a control bar and connection portions thereof associated with a brace in accordance with this disclosure.

Referring to FIG. 10, the concrete form 100 can further include a control bar 113 operatively connected to each brace 103 to move the braces 103 between the retracted position (e.g., as shown in FIG. 1) and the bracing position (e.g., as shown in FIG. 2). The control bar 113 can be hingedly connected to at least one of the braces 103 such that moving the control bar 113 vertically can move one or more of the braces 103 between the retracted and bracing positions. For example, as shown in FIG. 8, the control bar 113 can include one or more hinge mounts 113*a* and brace 103 can include one or more mating mount 103*a* configured to mate with the hinge mounts 113*a*.

In certain embodiments, the control bar 113 can extend through the scaffold member 109 via hole 107*c* in scaffold member 107. In this manner, the control bar 113 can be attached to a surface defining the hole 107*c* in any suitable manner (e.g., via a hinge mounts 113*a* connecting to a mating mount 103*a* attached on an inner surface defining hole 107*c*).

Figure 11:
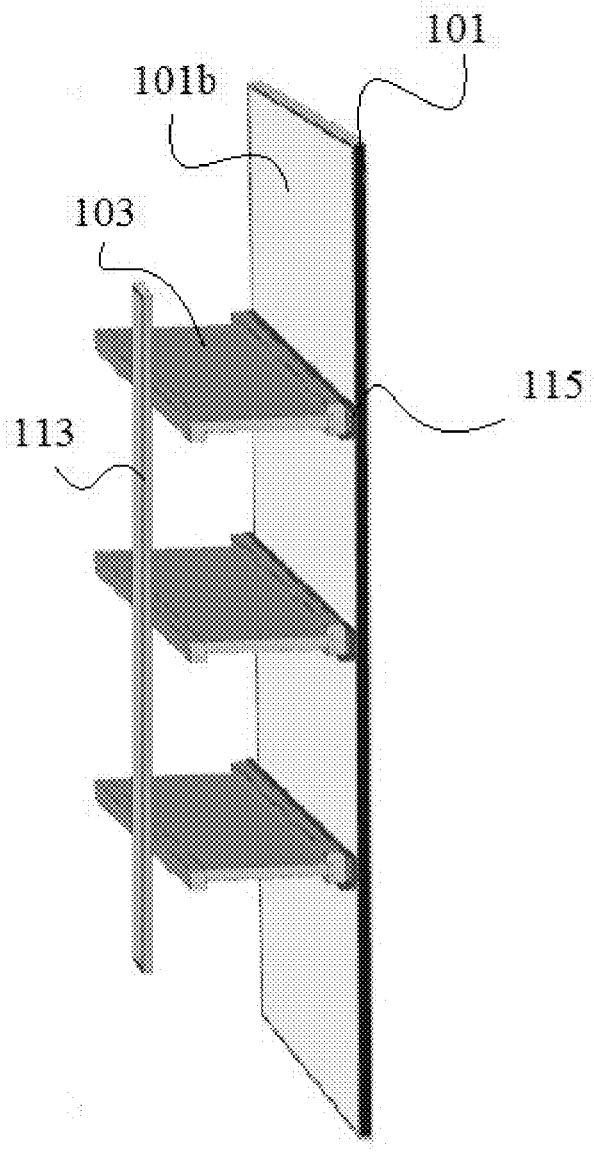
FIG. 11 is a perspective view of the concrete form of FIG. 1 with braces in the bracing position, showing L-shaped brace stops disposed under each brace on a side facing the forming wall.
Figure 12:
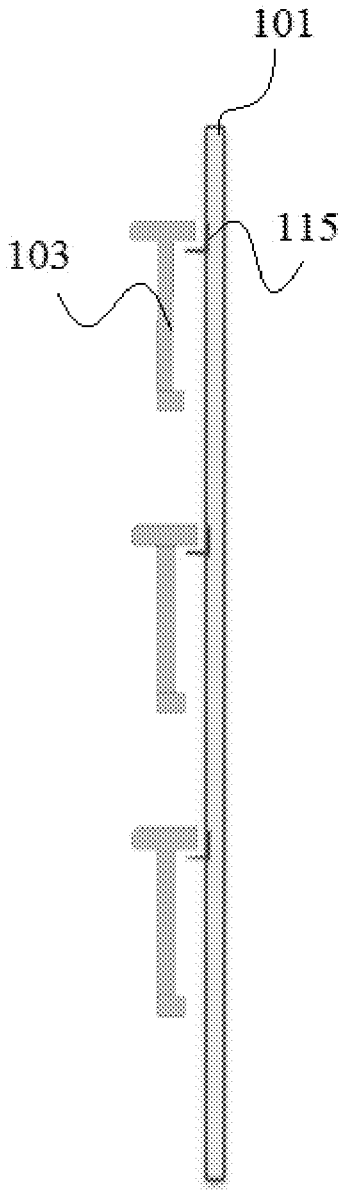
FIG. 12 is a side elevation view of the form as shown in FIG. 11 shown with braces in the retracted position.

Referring to FIG. 11-12, the concrete form 100 can include a plurality of brace stops 115 operatively disposed on the bracing side 101*b* of the forming wall 101 and in communication with each brace 103 such that each brace stop 115 aligns each brace 103 perpendicular to the forming wall 101 when the braces 103 are in the bracing position. For example, when the braces 103 are moved from a retracted position (e.g., as shown in FIG. 12) to the bracing position (e.g., as shown in FIG. 11), the brace stops 115 prevent each brace 103 (including scaffold member 107) from over rotating past a 90 degree angle with the forming wall 101. As shown, the brace stops 115 can include angled bracket members (e.g., L-brackets) disposed on the bracing side 101*b*.

A suitable locking system can be operatively connected to at least one of the braces 103, the control bar 113, the angled bracket members 109, and/or the brace stops 115 to lock the braces 103 in one or both of the retracted position and/or the bracing position.

Referring to FIG. 13, a plurality of forms 100 are shown sandwiching a volume of concrete therebetween. The forms 100 can be connected via a rod 119 (e.g., tapered as shown) passing through apertures 105 which can also include a suitable coating thereon to prevent concrete from sticking thereto so that the rod 119 can be removed from the concrete. The rod 119 can also include a rod pin 119*a* to prevent the rod 119 from retracting through apertures 105. Any other suitable connection system is contemplated herein.

In another aspect, the description provides an assembly of a plurality of forms or panels as described herein. In a preferred embodiment, the plurality of forms are juxtaposed or in apposition, and reversibly interconnected in at least one of vertically, horizontally or a combination thereof.

The methods and systems of the present disclosure, as described above and shown in the drawings, provide for improved concrete forms with superior properties including, for example, quick assembly and modularity. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A concrete form, comprising:

a forming wall including a concrete contact side and a bracing side;

a plurality of braces movably connected to the bracing side of the forming wall, wherein the plurality of braces reversibly move between a retracted position and a bracing position at least one of the plurality of braces is a scaffold member;

a control bar extends through the scaffold member and is operatively connected to each brace to move the plurality of braces between the retracted position and the bracing position, and is hingedly connected to at least one of the braces; and two angled bracket members attached to opposite edges of the forming wall and configured to receive a hinge pin therein, wherein the hinge pin is configured to hingedly mount each brace to the bracing side of the forming wall.

2. The concrete form of claim 1, wherein at least one of:

the forming wall is plywood;

the concrete contact side of the forming wall includes a coating for preventing concrete from adhering thereto; or a combination thereof.

3. The concrete form of claim 1, wherein each angled bracket member includes keyhole fastener slots for joining a plurality of concrete forms together.

4. The concrete form of claim 3, further comprising a plurality of brace stops operatively disposed on the bracing side of the forming wall and in communication with each brace such that each brace stop aligns each brace perpendicular to the forming wall.

5. The concrete form of claim 4, wherein the brace stops include angled bracket members disposed on the bracing side.

6. The concrete form of claim 5, wherein the scaffold member includes scaffold supports configured to support the scaffold member when the scaffold member is in the bracing position.

7. The concrete form of the claim 6, wherein the scaffold supports are hingedly mounted to the scaffold member to move between a folded position such that each of the scaffold supports is folded against the scaffold member, and a support position such that the scaffold supports are perpendicular to the scaffold member.

8. The concrete form of claim 7, wherein the scaffold supports are triangular shaped members.

9. The concrete form of claim 8, wherein the scaffold member includes a plurality of holes defined therein to reduce weight of the scaffold member.

10. The concrete form of claim 9, wherein the forming wall includes a plurality of cross-brace apertures, each cross-brace aperture disposed between a pair of braces.

11. The concrete form of claim 10, wherein each of the cross-brace apertures is accessible when the braces are in either of the retraced position and the bracing position.

12. The concrete form of claim 11, wherein the plurality of cross-brace apertures include different sizes to accommodate different portions of a tapered connection rod.

13. A concrete form, comprising:

a forming wall including a concrete contact side and a bracing side;

a plurality of braces movably connected to the bracing side of the forming wall, wherein the plurality of braces reversibly move between a retracted position and a bracing position, and include at least one I-beam; and a control bar operatively connected to each brace to move the plurality of braces between the retracted position and the bracing position.

14. The concrete form of claim 13, wherein at least one of:

the forming wall is plywood;

at least one of the plurality of braces is a scaffold member;

the concrete contact side of the forming wall includes a coating for preventing concrete from adhering thereto; or a combination thereof.

15. The concrete form of claim 13, wherein the control bar is hingedly connected to at least one of the braces.

16. The concrete form of claim 15, wherein the control bar extends through the scaffold member.

17. The concrete form of claim 16, further comprising two angled bracket members attached to opposite edges of the forming wall and configured to receive a hinge pin therein, wherein the hinge pin is configured to hingedly mount each brace to the bracing side of the forming wall.

18. The concrete form of claim 17, wherein each angled bracket member includes keyhole fastener slots for joining a plurality of concrete forms together.

19. The concrete form of claim 18, further comprising a plurality of brace stops operatively disposed on the bracing side of the forming wall and in communication with each brace such that each brace stop aligns each brace perpendicular to the forming wall.

20. The concrete form of claim 19, wherein the brace stops include angled bracket members disposed on the bracing side.

21. The concrete form of claim 20, wherein the scaffold member includes scaffold supports configured to support the scaffold member when the scaffold member is in the bracing position.

22. The concrete form of the claim 21, wherein the scaffold supports are hingedly mounted to the scaffold member to move between a folded position such that each of the scaffold supports is folded against the scaffold member, and a support position such that the scaffold supports are perpendicular to the scaffold member.

23. The concrete form of claim 22, wherein the scaffold supports are triangular shaped members.

24. The concrete form of claim 23, wherein the scaffold member includes a plurality of holes defined therein to reduce weight of the scaffold member.

25. The concrete form of claim 24, wherein the forming wall includes a plurality of cross-brace apertures, each cross-brace aperture disposed between a pair of braces.

26. The concrete form of claim 25, wherein each of the cross-brace apertures is accessible when the braces are in either of the retraced position and the bracing position.

27. The concrete form of claim 26, wherein the plurality of cross-brace apertures include different sizes to accommodate different portions of a tapered connection rod.

28. A concrete forming system, comprising:

a plurality of concrete forms, each form comprising, a forming wall including a concrete contact side and a bracing side;

a plurality of braces movably connected to the bracing side of the forming wall, wherein the plurality of braces reversibly move between a retracted position and a bracing position; and a control bar hingedly connected to each of the plurality of braces, wherein the control bar is configured and arranged to move the braces between the retracted and bracing position, at least two of the plurality of concrete forms are in opposed relationship with the concrete contact sides of the opposed forms facing each other to retain a quantity of concrete therebetween, the opposed forms connected by a rod passing through apertures formed in each panel.

* * * * *